US008683965B2

(12) United States Patent
Pierik

(10) Patent No.: US 8,683,965 B2
(45) Date of Patent: Apr. 1, 2014

(54) ENGINE ASSEMBLY INCLUDING CAMSHAFT ACTUATOR

(75) Inventor: Ronald Jay Pierik, Holly, MI (US)

(73) Assignee: GM Global Technology Operations, LLC, Detroit, MI (US)

( * ) Notice: Subject to any disclaimer, the term of this patent is extended or adjusted under 35 U.S.C. 154(b) by 317 days.

(21) Appl. No.: 13/104,106

(22) Filed: May 10, 2011

(65) Prior Publication Data

US 2012/0285405 A1 Nov. 15, 2012

(51) Int. Cl.
*F01L 1/34* (2006.01)

(52) U.S. Cl.
USPC ..... 123/90.15; 123/90.17; 123/90.18

(58) Field of Classification Search
USPC ..... 123/90.15–90.18
See application file for complete search history.

(56) References Cited

U.S. PATENT DOCUMENTS

| | | | | | |
|---|---|---|---|---|---|
| 5,125,372 | A * | 6/1992 | Gondek | ..... | 123/90.17 |
| 5,253,546 | A * | 10/1993 | Elrod et al. | ..... | 74/567 |
| 5,509,384 | A * | 4/1996 | Schmid | ..... | 123/90.17 |
| 5,704,317 | A * | 1/1998 | Barth | ..... | 123/90.17 |
| 5,860,328 | A * | 1/1999 | Regueiro | ..... | 74/568 R |
| 5,862,783 | A * | 1/1999 | Lewis | ..... | 123/90.17 |
| 6,199,522 | B1 * | 3/2001 | Regueiro | ..... | 123/90.15 |
| 6,640,760 | B1 * | 11/2003 | Plasencia | ..... | 123/90.17 |
| 6,745,736 | B2 * | 6/2004 | Walters | ..... | 123/90.18 |
| 7,270,096 | B2 * | 9/2007 | Lancefield et al. | ..... | 123/90.17 |
| 7,287,499 | B2 * | 10/2007 | Lawrence et al. | ..... | 123/90.17 |
| 7,510,267 | B2 * | 3/2009 | Silverbrook | ..... | 347/47 |
| 7,540,267 | B1 * | 6/2009 | Sellars | ..... | 123/90.31 |
| 7,753,019 | B2 * | 7/2010 | Litorell et al. | ..... | 123/90.18 |
| 8,381,694 | B2 * | 2/2013 | Niiro | ..... | 123/90.17 |
| 2001/0023674 | A1 * | 9/2001 | Shimizu et al. | ..... | 123/90.18 |
| 2002/0170514 | A1 * | 11/2002 | Methley | ..... | 123/90.16 |
| 2006/0000433 | A1 * | 1/2006 | Suzuki et al. | ..... | 123/90.6 |
| 2006/0060159 | A1 * | 3/2006 | Moretz et al. | ..... | 123/90.17 |
| 2008/0230026 | A1 * | 9/2008 | Litorell et al. | ..... | 123/90.17 |
| 2009/0126662 | A1 * | 5/2009 | Sellars | ..... | 123/90.17 |
| 2009/0288480 | A1 * | 11/2009 | Noda | ..... | 73/114.79 |
| 2012/0285405 | A1 * | 11/2012 | Pierik | ..... | 123/90.15 |

* cited by examiner

*Primary Examiner* — Thomas Denion
*Assistant Examiner* — Steven D Shipe
(74) *Attorney, Agent, or Firm* — Harness, Dickey & Pierce, P.L.C.

(57) ABSTRACT

An engine assembly may include an engine structure, a camshaft supported for rotation on the engine structure, a drive member and a camshaft actuation assembly. The camshaft may include a first shaft, a second shaft located within the first shaft and rotatable relative to the first shaft, a first cam lobe located on the first shaft and fixed for rotation with the first shaft and a second cam lobe supported for rotation on the first shaft and fixed for rotation with the second shaft. The drive member may be fixed to a first axial end of the camshaft and rotationally driven to drive rotation of the camshaft. The camshaft actuation assembly may include an actuator coupled to a second axial end of the camshaft and rotationally fixed to the engine structure and relative to the camshaft.

12 Claims, 5 Drawing Sheets

ENGINE ASSEMBLY INCLUDING CAMSHAFT ACTUATOR

FIELD

The present disclosure relates to engine camshaft arrangements.

BACKGROUND

This section provides background information related to the present disclosure which is not necessarily prior art.

Internal combustion engines may combust a mixture of air and fuel in cylinders and thereby produce drive torque. Combustion of the air-fuel mixture produces exhaust gases. Engines may include intake ports to direct air flow to the combustion chambers and exhaust ports to direct exhaust gases from the combustion chambers. Camshafts are used to displace intake and exhaust valves between open and closed positions to selectively open and close the intake and exhaust valves.

SUMMARY

An engine assembly may include an engine structure, a camshaft supported for rotation on the engine structure, a drive member and a camshaft actuation assembly. The camshaft may include a first shaft, a second shaft located within the first shaft and rotatable relative to the first shaft, a first cam lobe located on the first shaft and fixed for rotation with the first shaft and a second cam lobe supported for rotation on the first shaft and fixed for rotation with the second shaft. The drive member may be fixed to a first axial end of the camshaft and rotationally driven to drive rotation of the camshaft. The camshaft actuation assembly may include an actuator coupled to a second axial end of the camshaft and rotationally fixed to the engine structure and relative to the camshaft.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
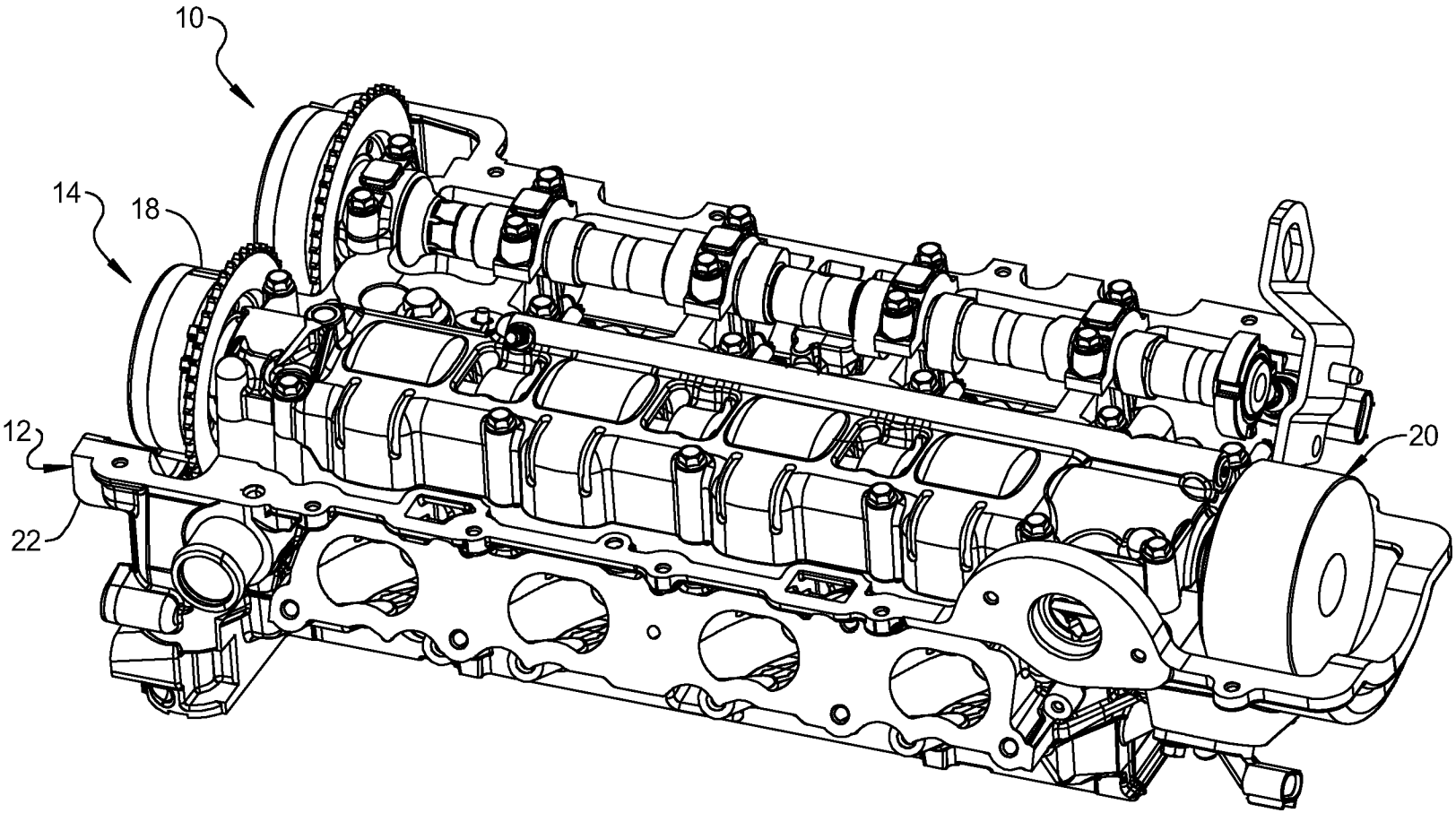
FIG. 1 is a perspective view of an engine assembly according to the present disclosure.
Figure 2:
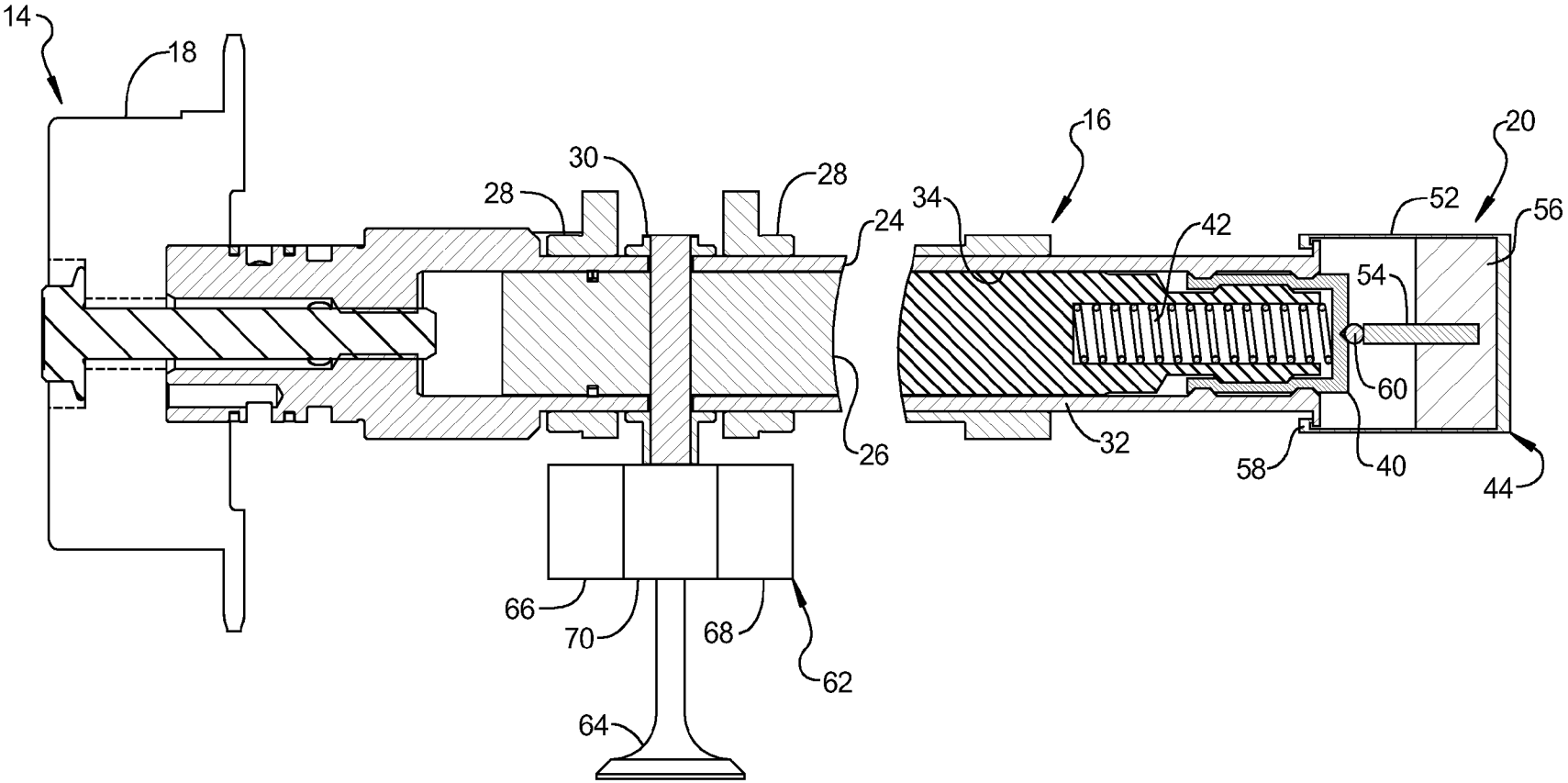
FIG. 2 is a fragmentary section view of the engine assembly shown in FIG. 1.

An engine assembly 10 is illustrated in FIGS. 1 and 2 and may include an engine structure 12 and a camshaft assembly 14 supported on the engine structure 12. The camshaft assembly 14 may include a camshaft 16, a cam phaser 18 and a camshaft actuation assembly 20. The engine structure 12 may include a cylinder head 22 supporting the camshaft 16, the cam phaser 18 and the camshaft actuation assembly 20. While illustrated in combination with an overhead cam arrangement, it is understood that the present teachings apply to both overhead cam and cam-in-block configurations. Additionally, it is understood that the present teachings apply to any number of piston-cylinder arrangements and a variety of reciprocating engine configurations including, but not limited to, V-engines, inline engines, and horizontally opposed engines, as well as both gasoline and diesel applications. It is also understood that the present teachings may be applied to transmission components including inner and outer shafts needing angular orientation or restraint during assembly.

Figure 3:
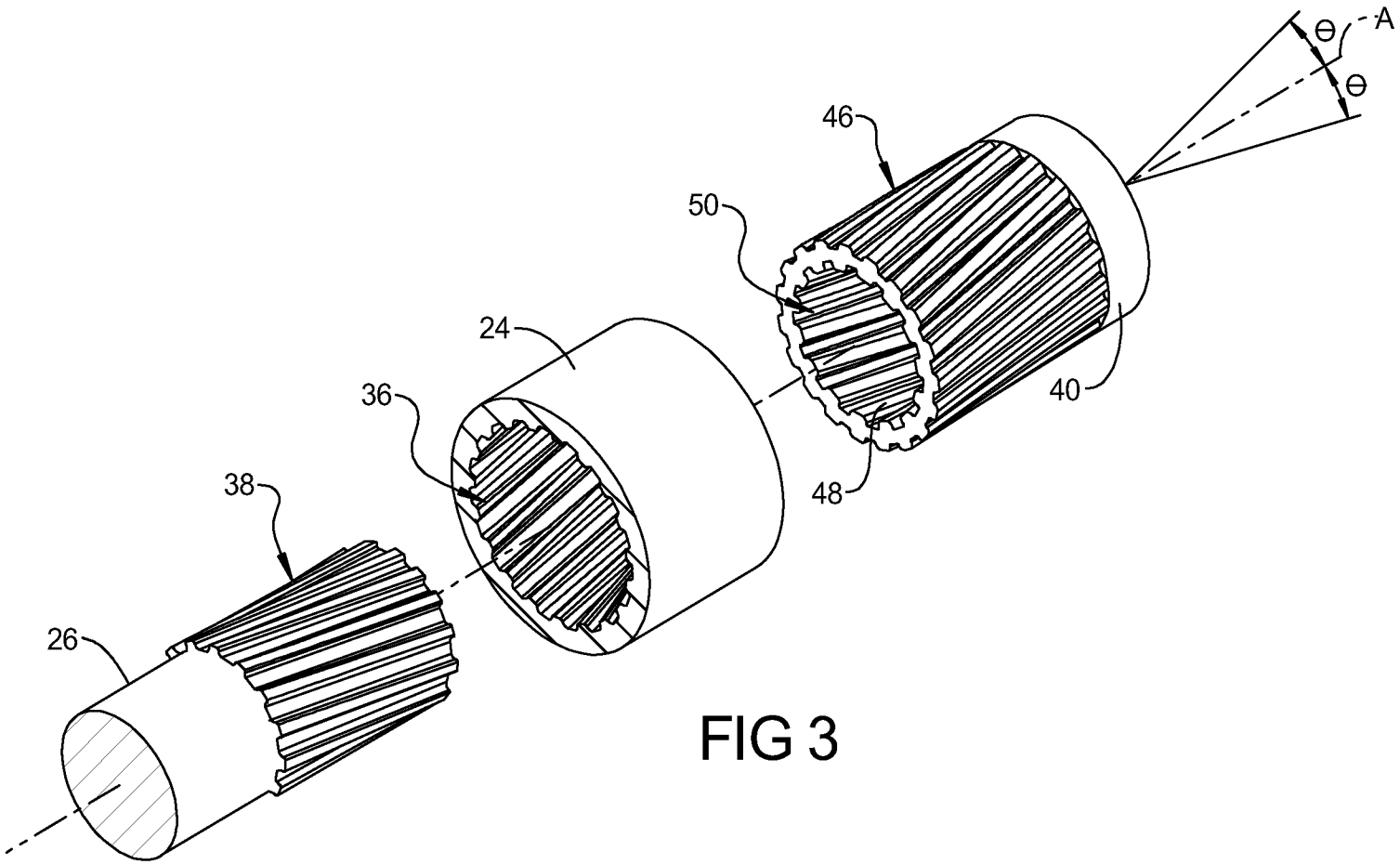
FIG. 3 is an exploded view of a portion of the camshaft actuator shown in FIGS. 1 and 2.

In the present non-limiting example, the camshaft 16 includes a first shaft 24, a second shaft 26, first cam lobes 28 and second cam lobes 30. The first shaft 24 may include an annular wall 32 defining an axial bore 34 and the second shaft 26 may be supported for rotation within the axial bore 34 of the first shaft 24. The first cam lobes 28 may be located on and fixed for rotation with the first shaft 24. The second cam lobes 30 may be located on the first shaft 24 and fixed for rotation with the second shaft 26. As seen in FIGS. 2 and 3, the first shaft 24 may define a first set of helical splines 36 on the inner circumference and the second shaft 26 may define a second set of helical splines 38 on the outer circumference.

For simplicity, the cam phaser 18 and the camshaft actuation assembly 20 are illustrated schematically in FIG. 2. The cam phaser 18 may be coupled to a first axial end of the camshaft 16 and the camshaft actuation assembly 20 may be coupled to a second axial end of the camshaft 16 opposite the first axial end. The cam phaser 18 may be secured for rotation with the camshaft 16. The camshaft actuation assembly 20 may be rotationally secured relative to the camshaft 16 and may be fixed to the engine structure 12. In the present non-limiting example, the camshaft actuation assembly 20 may be fixed to the cylinder head 22.

As seen in FIGS. 2 and 3, the camshaft actuation assembly 20 may include a piston 40, a biasing member 42 and an actuator 44. The piston 40 may include define a third set of helical splines 46 on an outer circumference and may include an axial bore 48 defining a fourth set of splines 50 on an inner circumference of the axial bore 48. The piston 40 may be located within the axial bore 34 of the first shaft 24 at the second axial end of the camshaft 16 and the first set of splines 36 may be engaged with the third set of splines 46. The second shaft 26 may be located within the axial bore 48 of the piston 40 and the second set of splines 38 may be engaged with the fourth set of splines 50. The first, second, third, and fourth sets of splines 36, 38, 46, 50 may each be disposed at an angle (θ) relative to the rotational axis (A) of the camshaft 16. In the present non-limiting example, the angle (θ) is less than thirty-five degrees. The rotational orientation of the first and third sets of splines 36, 46 may be opposite the rotational orientation of the second and fourth sets of splines 38, 50.

The piston 40 may be fixed for rotation with the camshaft 16 through the engagement between the splines 36, 38, 46, 50 and the biasing member 42 may be engaged with the piston 40 and the second shaft 26 and may force the piston 40 in an outward axial direction toward the actuator 44. In one arrangement, the orientation of the splines 36, 38, 46, 50 may result in the biasing member 42 normally biasing the second cam lobes 30 into a rotationally advanced position relative to the first cam lobes 28. In another arrangement, where the orientation of the splines 36, 38, 46, 50 is reversed, the biasing member 42 may normally bias the second cam lobes 30 into a rotationally retarded position relative to the first cam lobes 28. In the present non-limiting example, the biasing member 42 includes a coiled compression spring. The actuator 44 may linearly displace the piston 40 to control the relative position of the second cam lobes 30 relative to the first cam lobes 28.

Figure 5:
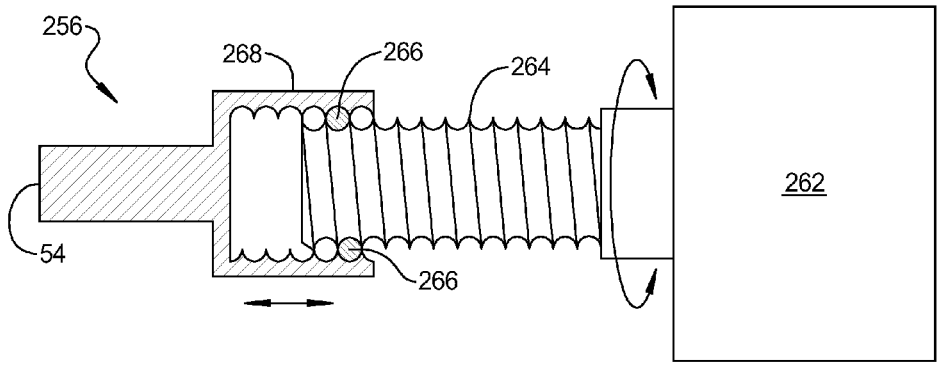
FIG. 5 is a schematic illustration of a second actuation assembly according to the present disclosure.
Figure 6:
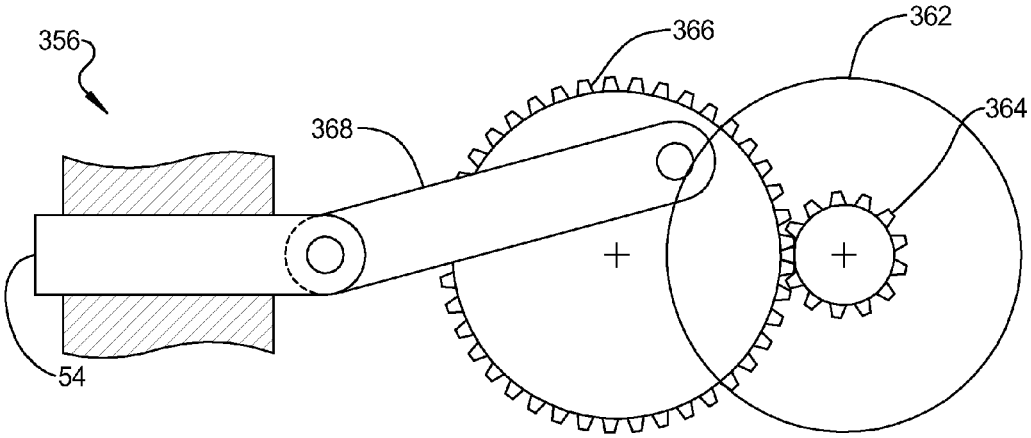
FIG. 6 is a schematic illustration of a third actuation assembly according to the present disclosure.

As seen in FIG. 2, the actuator 44 may include a housing 52, a pushrod 54 and an actuation mechanism 56. The housing 52 may be rotationally fixed relative to the camshaft 16 and may define a first thrust bearing 58 engaged with the camshaft 16 to inhibit axial displacement of the camshaft 16 during operation. The pushrod 54 may be coupled to the actuation mechanism 56 and rotationally fixed relative to the camshaft 16. The pushrod 54 may be engaged with the piston 40 and the piston 40 may be rotatable relative to the pushrod 54. A second thrust bearing 60 may be located between the pushrod 54 and the piston 40. The actuation mechanism 56 may take a variety of forms. By way of non-limiting example, the actuation mechanism 56 may include a hydraulic actuation mechanism 156 (FIG. 4) or an electric actuation mechanism 256, 356 (FIGS. 5 and 6).

Figure 4:
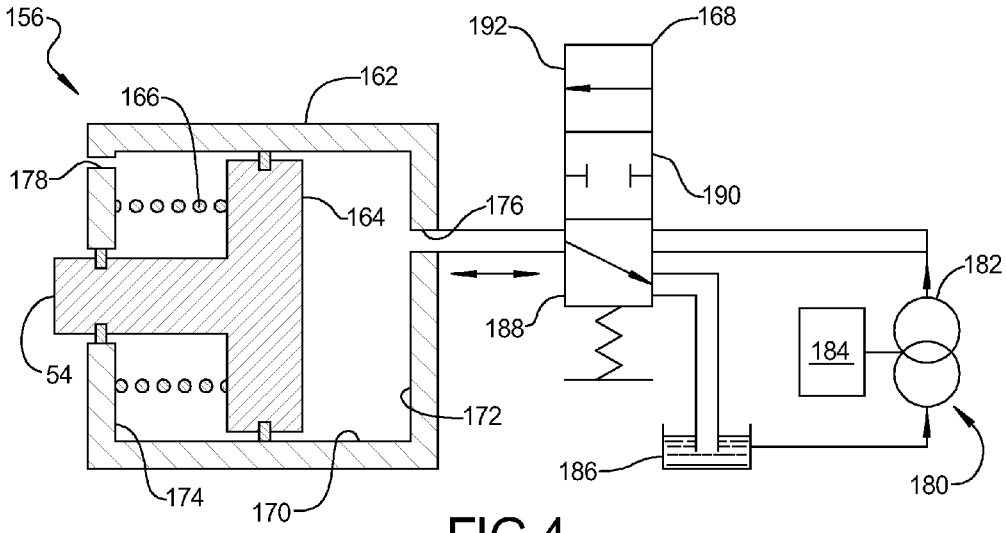
FIG. 4 is a schematic illustration of a first actuation assembly according to the present disclosure.

As seen in FIG. 4, the hydraulic actuation mechanism 156 may include a housing 162, a piston 164 fixed to the pushrod 54, a biasing member 166 and a control valve 168. The housing 162 may be formed in the cylinder head 22 or may be a separate housing. The housing 162 may define a chamber 170 housing the piston 164 and separated into first and second portions 172, 174 by the piston 164. The housing 162 may define a first passage 176 in communication with the first portion 172 and the control valve 168 and a vent passage 178 in communication with the second portion 174.

A pressurized fluid supply 180 may be in communication with the control valve 168. In the present non-limiting example, the pressurized fluid supply 180 includes an oil pump 182 driven by a motor 184 and in communication with an oil sump 186. However, it is understood that pressurized oil from the engine assembly 10 may used in place of a dedicated oil pump 182. Further, it is understood that the pressurized fluid supply 180 is not limited to the use of oil.

The control valve 168 may control displacement of the piston 164 and, therefore, displacement of the pushrod 54. The control valve 168 may be displaced between three positions. In a first position, shown in FIG. 4, a first region 188 of the control valve 168 may define a flow path that places the first portion 172 of the chamber 170 in communication with the oil sump 186, venting the first portion 172 and allowing the biasing member 166 to displace the piston 164 and pushrod 54 in a direction axially outward from the camshaft 16. In a second position, not shown, a second region 190 of the control valve 168 may be in communication with the first portion 172 of the chamber 170 and may seal the first portion 172 and hold the piston 164 and pushrod 54 in a predetermined position. In a third position, not shown, a third region 192 of the control valve 168 may be in communication with the first portion 172 of the chamber 170 and may provide communication between the first portion 172 and the pressurized fluid supply 180 to displace the piston 164 and pushrod 54 in a direction axially toward from the camshaft 16.

As seen in FIG. 5, a first electric actuation mechanism 256 may include an electric motor 262, a lead screw 264, lead screw balls 266 and a lead screw nut 268 fixed to the pushrod 54. Alternatively, the first electric actuation mechanism 256 may include a lead screw arrangement without balls 266. During operation, the pushrod 54 is translated by rotation of the lead screw 264 via the electric motor 262. In the lead screw arrangement, the lead screw nut 268 and pushrod 54 are rotationally fixed and the lead screw 264 is rotated to drive rotation of the second shaft 26 relative to the first shaft 24 via the splined engagement. In some arrangements, the actuation mechanism 256 may additionally include a biasing member (not shown) urging the lead screw nut 268 and pushrod 54 in a direction axially outward from the camshaft 16.

As seen in FIG. 6, a second electric actuation mechanism 356 may include an electric motor 362, a pinion gear 364, a driven gear 366 and a connecting rod 368. The pinion gear 364 may be coupled to and rotationally driven by the electric motor 362. The driven gear 366 may be engaged with and rotationally driven by the pinion gear 364. The connecting rod 368 may be coupled to the driven gear 366 and the pushrod 54 and may drive linear displacement of the pushrod 54 based on rotation of the driven gear 366 to drive rotation of the second shaft 26 relative to the first shaft 24 via the splined engagement. In some arrangements, the actuation mechanism 356 may additionally include a biasing member (not shown) urging the connecting rod 368 and pushrod 54 in a direction axially outward from the camshaft 16.

While three examples of the actuation mechanism 56 are illustrated, it is understood that the actuation mechanism may take a variety of alternate forms including, but not limited to, an electric motor in combination with a barrel cam arrangement or a worm gear box based actuator.

During operation, linear displacement of the pushrod 54 via the actuation mechanism 56 may be translated into rotational displacement of the second shaft 26 and second cam lobes 30 relative to the first shaft 24 and first cam lobes 28. As the piston 40 is displaced axially, the splined engagement between the first and third sets of splines 36, 46 causes the piston 40 to rotate within the first shaft 24. The splined engagement between the second and fourth sets of splines 38, 50 (in the opposite orientation) causes the second shaft 26 to rotate relative to the piston 40 and the first shaft 24 in the rotational direction of the piston 40. As a result, the second camshaft and second cam lobes 30 are rotationally driven relative to the first shaft 24 and first cam lobes 28 while the actuation mechanism 56 is rotationally fixed relative to the camshaft 16 (both the first and second shafts 24, 26 and the first and second cam lobes 28, 30). Therefore, the mass moment of inertia of the actuation mechanism 56 may be separated from camshaft 16.

As illustrated in FIG. 2, the camshaft assembly 14 discussed above may be used in combination with a valve lift mechanism 62 engaged with the first and second cam lobes 28, 30 and a valve 64 to vary the lift duration and/or height of the valve 64 based on the rotational position of the second cam lobes 30 relative to the first cam lobes 28. The valve lift mechanism 62 may include first and second regions 66, 68 engaged with the first cam lobes 28 and a third region 70 located between the first and second regions 66, 68 and engaged with the second cam lobe 30.

What is claimed is:

1. A camshaft assembly comprising:

a camshaft including a first shaft defining an axial bore, a second shaft located within the axial bore of the first shaft and rotatable relative to the first shaft, the second shaft including an axially extending cavity in an end thereof, a first cam lobe located on the first shaft and fixed for rotation with the first shaft and a second cam lobe supported for rotation on the first shaft and fixed for rotation with the second shaft;

a drive member fixed to a first axial end of the camshaft and rotationally driven to drive rotation of the camshaft; and a camshaft actuation assembly including an actuator coupled to a second axial end of the camshaft and rotationally fixed to an engine structure and relative to the camshaft, wherein the actuator is engaged with the first and second shafts and rotationally drives the second shaft relative to the first shaft, wherein the first shaft defines a first set of helical splines on an interior surface of the axial bore and the second shaft defines a second set of helical splines on an exterior surface of the second shaft, the actuator including a piston defining a cylindrical wall at least partially located within the axial bore of the first shaft and surrounding an end of the second shaft and being axially displaceable relative to the camshaft, the piston having an outer circumference of the cylindrical wall defining a third set of helical splines engaged with the first set of helical splines and an inner bore of the cylindrical wall defining a fourth set of helical splines engaged with the second set of helical splines, axial displacement of the piston providing rotation of the second shaft within the first shaft, wherein the first and third sets of helical splines are oriented in a first rotational direction and the second and fourth sets of helical splines are oriented in a second rotational direction opposite the first rotational direction, wherein the actuator includes a biasing member disposed within the cavity in said second shaft and engaged with the piston and the second shaft and biasing the piston in a direction axially outward from the second shaft.

2. The camshaft assembly of claim 1, wherein the drive member includes a cam phaser fixed to the first shaft.

3. The camshaft assembly of claim 1, wherein the engagement between the biasing member and the second shaft rotationally biases the second cam lobe relative to the first cam lobe in a rotational direction of the camshaft.

4. The camshaft assembly of claim 1, wherein the actuator includes a chamber housing the piston and in communication with a pressurized fluid to provide linear displacement of the piston.

5. The camshaft assembly of claim 1, wherein the actuator includes a motor driving linear displacement of the piston.

6. The camshaft assembly of claim 1, wherein the actuator includes a thrust bearing engaged with the camshaft.

7. An engine assembly comprising:

an engine structure a camshaft supported for rotation on the engine structure and including a first shaft defining an axial bore, a second shaft located within the axial bore of the first shaft and rotatable relative to the first shaft, the second shaft including an axially extending cavity in an end thereof, a first cam lobe located on the first shaft and fixed for rotation with the first shaft and a second cam lobe supported for rotation on the first shaft and fixed for rotation with the second shaft;

a drive member fixed to a first axial end of the camshaft and rotationally driven to drive rotation of the camshaft; and a camshaft actuation assembly including an actuator coupled to a second axial end of the camshaft and rotationally fixed to the engine structure and relative to the camshaft, wherein the actuator is engaged with the first and second shafts and rotationally drives the second shaft relative to the first shaft, wherein the first shaft defines a first set of helical splines on an interior surface of the axial bore and the second shaft defines a second set of helical splines on an exterior surface of the second shaft, the actuator including a piston defining a cylindrical wall at least partially located within the axial bore of the first shaft and surrounding an end of the second shaft and being axially displaceable relative to the camshaft, the piston having an outer circumference of the cylindrical wall defining a third set of helical splines engaged with the first set of helical splines and an inner bore of the cylindrical wall defining a fourth set of helical splines engaged with the second set of helical splines, axial displacement of the piston providing rotation of the second shaft within the first shaft, wherein the first and third sets of helical splines are oriented in a first rotational direction and the second and fourth sets of helical splines are oriented in a second rotational direction opposite the first rotational direction, wherein the actuator includes a biasing member disposed within a cavity in an end of said second shaft and engaged with the piston and the second shaft and biasing the piston in a direction axially outward from the second shaft.

8. The engine assembly of claim 7, wherein the drive member includes a cam phaser fixed to the first shaft.

9. The engine assembly of claim 7, wherein the engagement between the biasing member and the second shaft rotationally biases the second cam lobe relative to the first cam lobe in a rotational direction of the camshaft.

10. The engine assembly of claim 7, wherein the actuator includes a chamber housing the piston and in communication with a pressurized fluid to provide linear displacement of the piston.

11. The engine assembly of claim 7, wherein the actuator includes a motor driving linear displacement of the piston.

12. The engine assembly of claim 7, wherein the actuator includes a thrust bearing engaged with the camshaft.

* * * * *